United States Patent [19]

Kaneko

[11] Patent Number: 4,688,660

[45] Date of Patent: Aug. 25, 1987

[54] WINCH FOR ELEVATOR

[75] Inventor: Masatoshi Kaneko, Tokyo, Japan

[73] Assignee: Kabushiki Kaisha Kaneko Seisakusho, Tokyo

[21] Appl. No.: 841,427

[22] Filed: Mar. 19, 1986

[51] Int. Cl.[4] ..... B66B 11/04

[52] U.S. Cl. ..... 187/20; 188/171; 184/6.12

[58] Field of Search ..... 187/20, 39, 17; 188/17.1, 166; 184/6.12, 6.28, 21, 11.2

[56] References Cited

U.S. PATENT DOCUMENTS

| | | | |
|---|---|---|---|
| 1,060,384 | 4/1913 | Valentine | 188/171 |
| 2,263,092 | 11/1941 | Johnson | 184/6.12 |
| 2,699,841 | 1/1955 | Gunderson | 184/6.12 |
| 2,732,041 | 1/1956 | Anderson | 188/171 |
| 3,805,919 | 4/1974 | Nakamura et al. | 184/6.12 |
| 3,827,311 | 8/1974 | Pere | 184/6.12 |
| 4,422,531 | 12/1983 | Ohtumi et al. | 187/20 |
| 4,526,252 | 7/1985 | Hirano | 187/20 |

FOREIGN PATENT DOCUMENTS

| | | | |
|---|---|---|---|
| 1930197 | 7/1968 | Fed. Rep. of Germany | 187/20 |

*Primary Examiner*—H. Grant Skaggs
*Assistant Examiner*—Kenneth Noland
*Attorney, Agent, or Firm*—George B. Oujevolk

[57] ABSTRACT

A winch for an elevator which is provided with a drive pulley rotated through a reduction gear by a motor and a brake unit provided between the motor and the reduction gear, makes it possible to produce the brake unit with a compact frame, light weight and low cost by fixing the frame of the brake unit to a casing of the reduction gear with bolts. Further, it can be assembled. easily for a short period of time. An annular oil keep groove is provided on the casing of the reduction gear. An annular oil interrupting projection disposed in the oil keep groove is provided on a hollow rotary shaft fixed the drive pulley. Therefore, lubricant is securely prevented from leakage from the inside of the casing for a long period of time.

4 Claims, 10 Drawing Figures

WINCH FOR ELEVATOR

BACKGROUND OF THE INVENTION

1. Field of the Invention

This invention relates to a winch for an elevator for vertically transferring men and articles in buildings or the like.

2. Description of the Prior Art

A conventional winch for an elevator will be explained with reference to FIGS. 8 to 10. A housing of a motor 1, a casing 6 of a reduction gear 2 and a stand type frame 79 of a brake unit 78 are secured to a base frame 24 by bolts, a drive shaft 28 provided with a worm 27 is journalled through bearings by the casing 6 and a coupling unit 30 mounted on a rotor shaft of the motor 1 and a coupling unit 31 mounted on the drive shaft 28 are coupled with each other by bolts 32 to constitute a braked member 33.

A hollow rotary shaft 10 has one end secured to a worm wheel 35 meshing with said worm 27 and the other end secured to a drive pulley 3 provided with a V shaped groove. Further, one end of a horizontal shaft 80 inserted into the hollow rotary shaft 10 is journalled by a bearing 82 in a bearing box 81 secured to the casing 6. The other end of the horizontal shaft 80 is journalled by a bearing 84 in a bearing box 83 secured to a support base 47. On a hollow rotary shaft penetrating portion in the casing 6 is fitted a sealing ring 85 made of felt contacting the peripheral surface of the hollow rotary shaft 10. A rubber sealing ring 86 is interposed between the casing 6 and the bearing box 81.

A solenoid 13 is secured to an upper portion of said stand type frame 79 and to both sides of the stand type frame 79 is connected pivotably about a pivot 18 to an intermediate portion of a brake arm 17 provided with a brake shoe 23. Each brake arm 17 is constituted to be pivoted by an iron core 14 inserted into both sides of said solenoid 13. Further, each brake arm 17 has one end engaging a brake spring 22.

However, in the case of said conventional winch for the elevator, the stand type frame 79 in the brake unit 78 is separated from the casing 6 of the reduction gear 2 and secured to the base frame 24 by bolts 87. Therefore, a large-scaled stand type frame 79 is needed so that the weight of the brake unit 78 is increased while high cost is brought about. Further, since the stand type frame 79 is necessary to be secured to the base frame 24 while the vertical position and left and right directional position (horizontal position orthogonal to the longitudinal direction of the drive shaft 28) of the brake shoe 23 with respect to the braked member 33 is accurately set, it is difficult to assemble the winch for the elevator, and a problem is presented that a relatively long period of time is taken for the assemblage of the winch. Also, the seal ring 85 provided between the casing 6 and the hollow rotary shaft 10 wears in its early stage due to the friction against the hollow rotary shaft 10, presenting a problem that lubricant leaks from between the casing 6 and the hollow rotary shaft 10.

SUMMARY OF THE INVENTION

A first object of the present invention is to provide a winch for an elevator which is provided with a drive pulley rotated by a motor through a reduction gear and a brake unit provided between the motor and the reduction gear, said winch for the elevator being characterized in that the brake unit has the small-sized frame and can be manufactured with light weight and low cost and further be easily assembled for a short period of time by fixing the frame of the brake unit with respect to a casing of the reduction gear by bolts.

A second object of the present invention is to support the frame of the brake unit on a predetermined position of the casing of the reduction gear so that the alignment of bolt holes in the frame with screw holes in the casing and the alignment of a brake shoe with respect to a braked member can be facilitated by securing a positioning pin to one of said frame and casing and providing a positioning pin hole in the other to fit said positioning pin into said positioning pin hole.

A third object of the present invention is to prevent securely lubricant from leakage from the inside of said casing for a long period of time by providing an annular oil keep groove on the casing of the reduction gear and providing an annular oil interrupting projection disposed in the oil keep groove on a hollow rotary shaft having a drive pulley fixed.

A fourth object of the present invention is to permit a clearance between the braked member and the brake shoes at both left and right sides thereof to be easily subjected to fine adjustment after the assemblage of the winch for the elevator.

The above-mentioned and other objects and features of the invention will become apparent from the following detailed description taken in conjunction with the drawings which indicate an embodiment of the invention.

BRIEF DESCRIPTION OF THE DRAWINGS

FIGS. 1 to 6 show an embodiment of the present invention, in which;

FIG. 1 is a side view, partly in section, showing a winch for an elevator;

FIG. 2 is a side view, partly in section, showing a brake unit and the mounting portion thereof;

FIG. 3 is a front view, partly in section, showing the brake unit;

FIG. 4 is a longitudinal sectional front view showing a transmission system between a reduction gear and a drive pulley;

FIG. 5 is a cross sectional plan view showing the condition of supporting a fixed support shaft and a hollow rotary shaft and a lubricant leakage preventing means;

FIG. 6 is a cross-sectional plan view showing a portion of a frame of the brake unit mounted on a casing of a reduction gear;

FIGS. 8 to 10 show a conventional winch for an elevator, in which;

FIG. 8 is a side view, partly in section, of same;

FIG. 9 is a front view, partly in section, showing the brake unit; and

FIG. 10 is a longitudinal sectional front view showing an engaging system between the reduction gear and the drive pulley.

DETAILED DESCRIPTION OF THE PREFERRED EMBODIMENT

Figure 1:
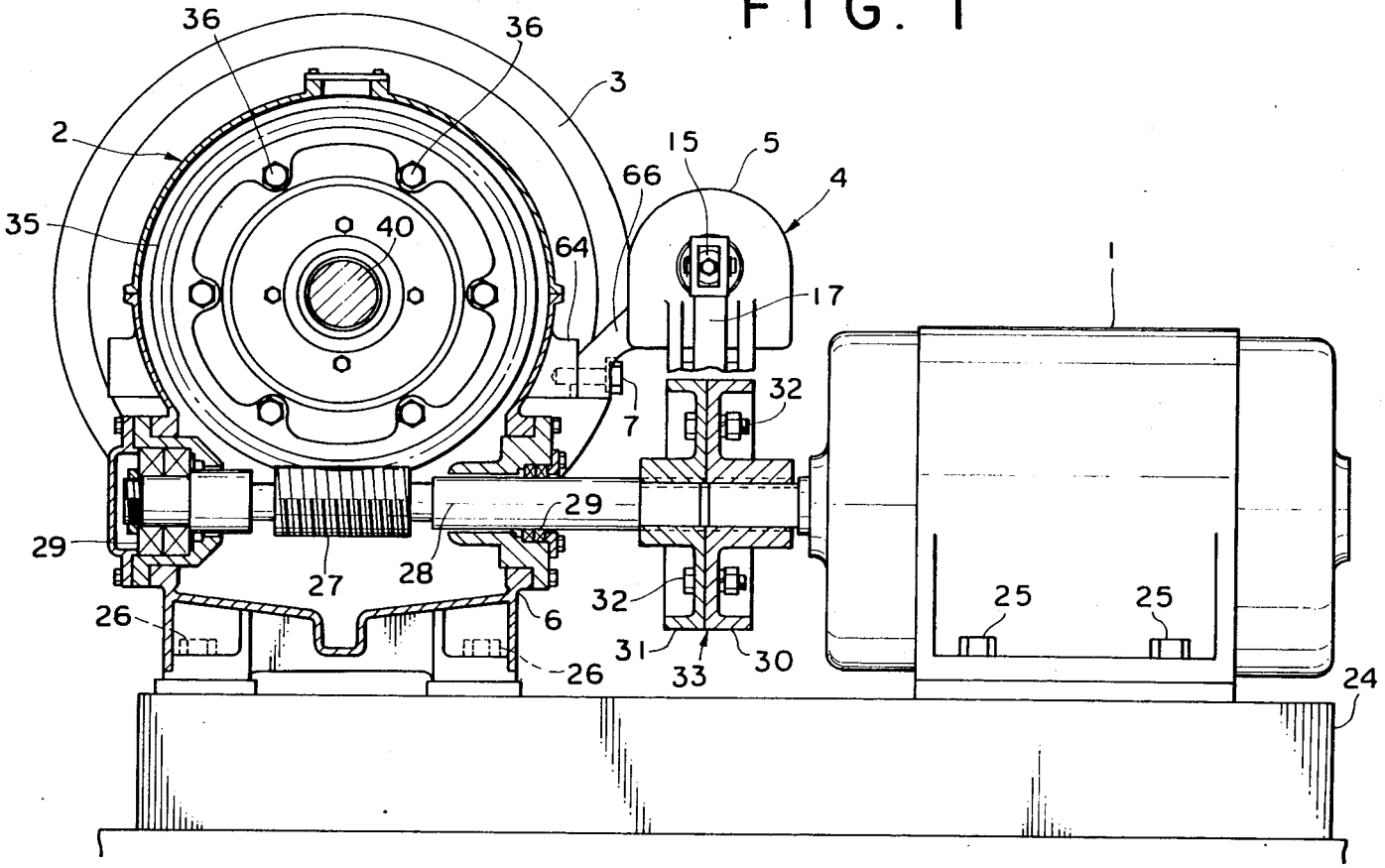
Figure 2:
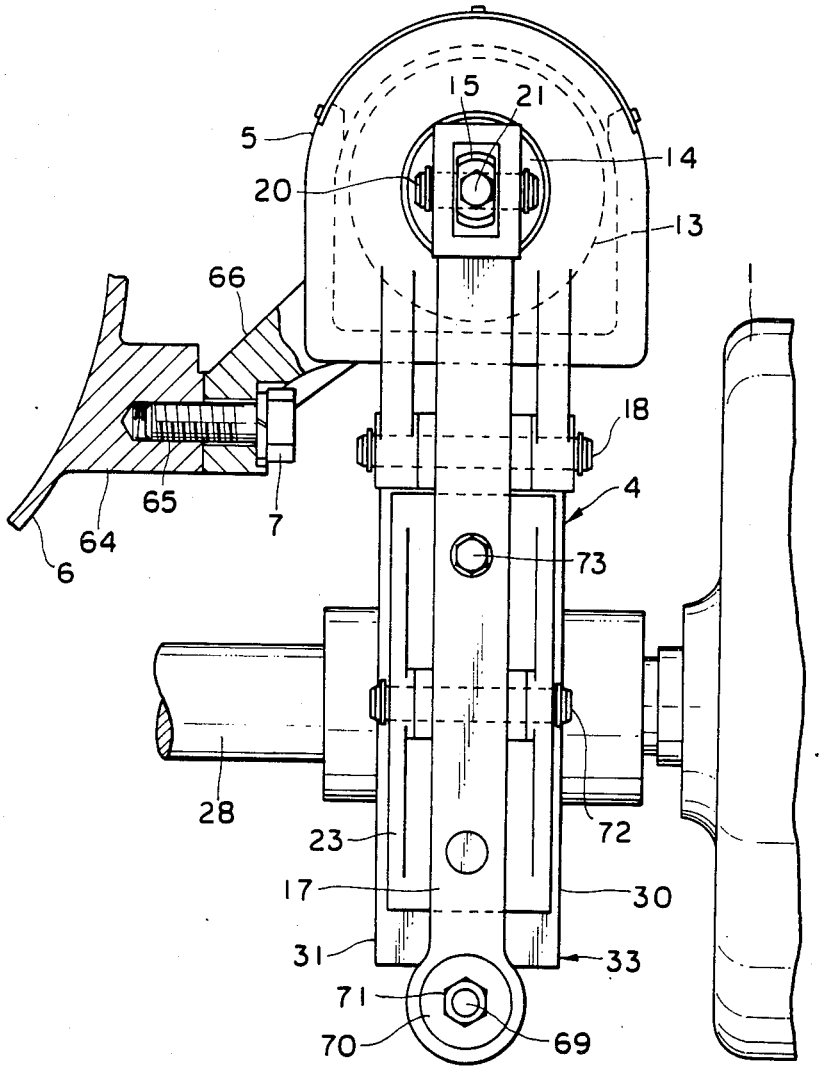
Figure 3:
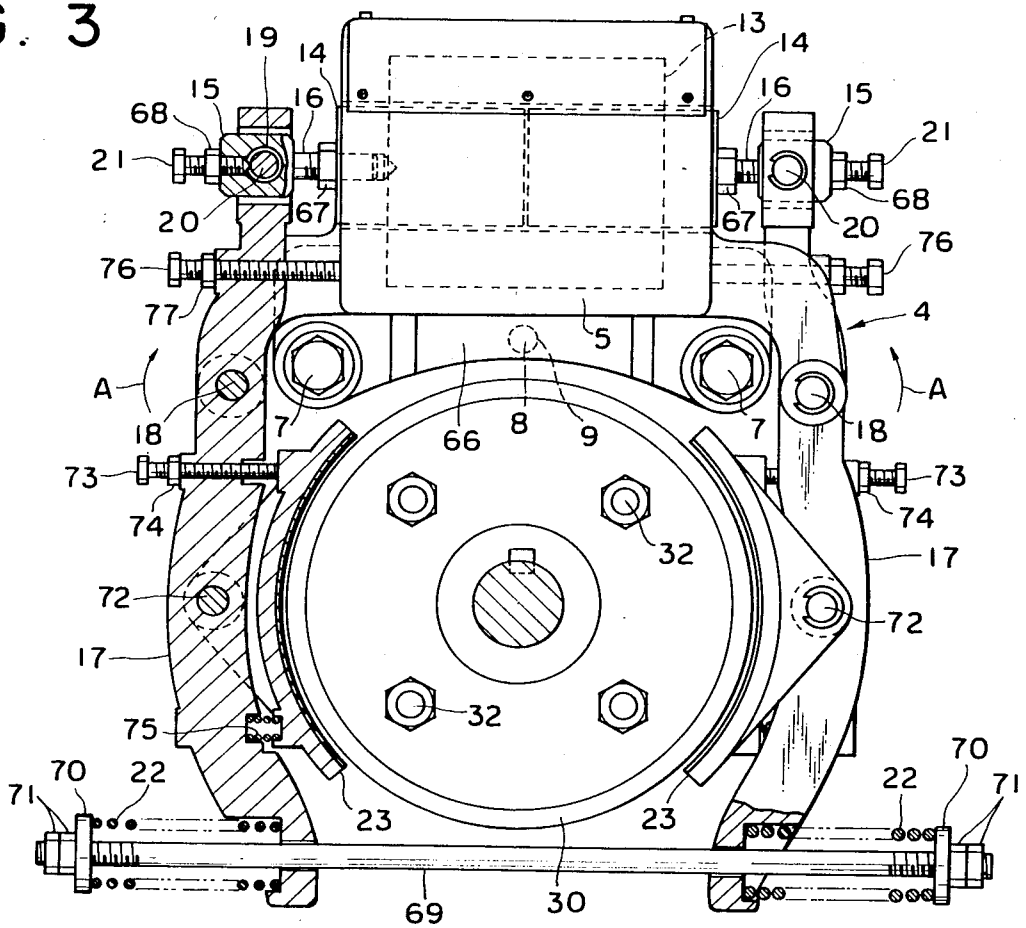
Figure 4:
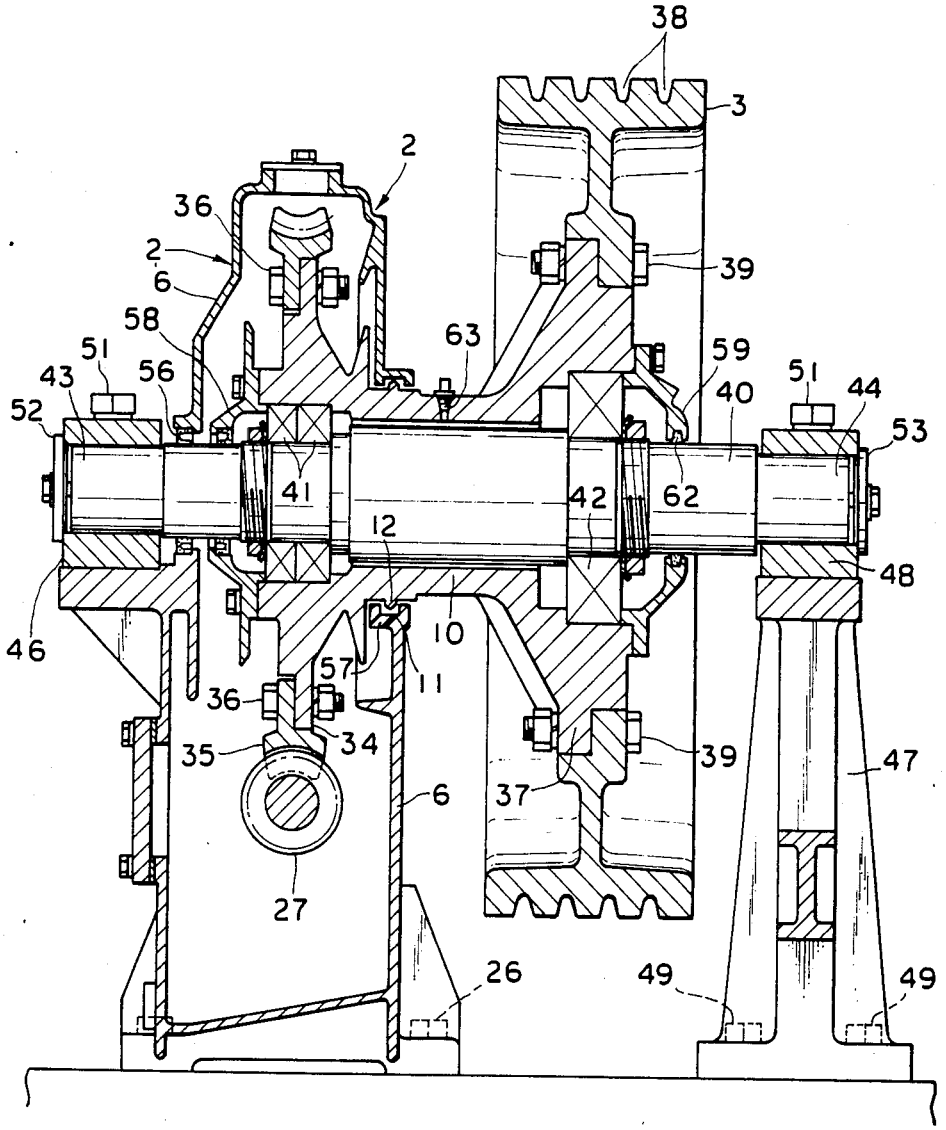
Figure 5:
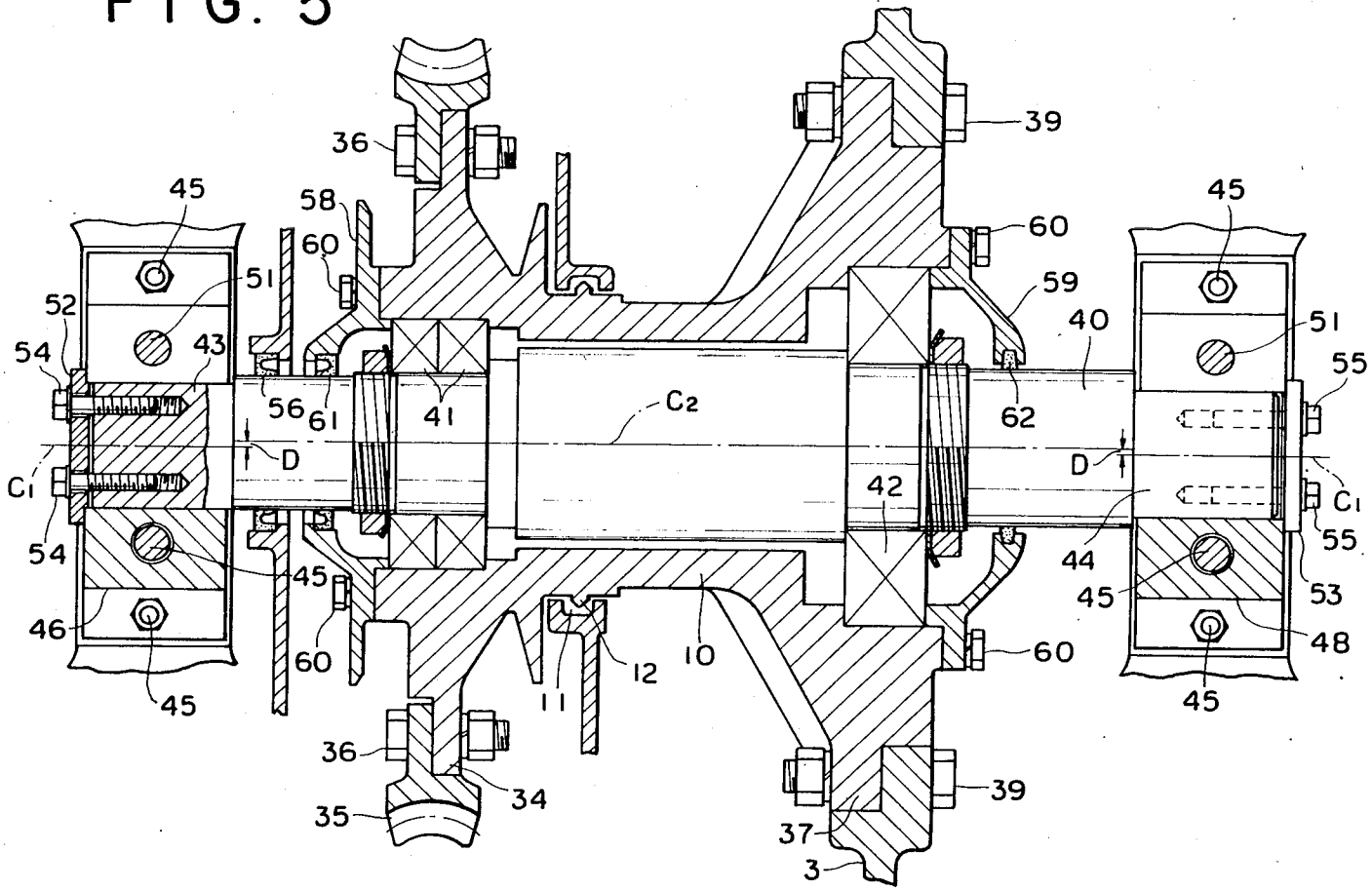
Figure 6:
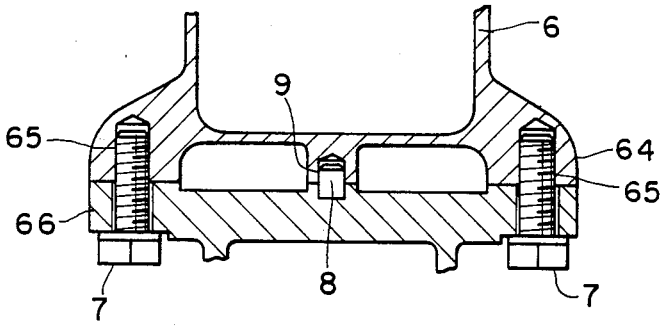
Figure 7:
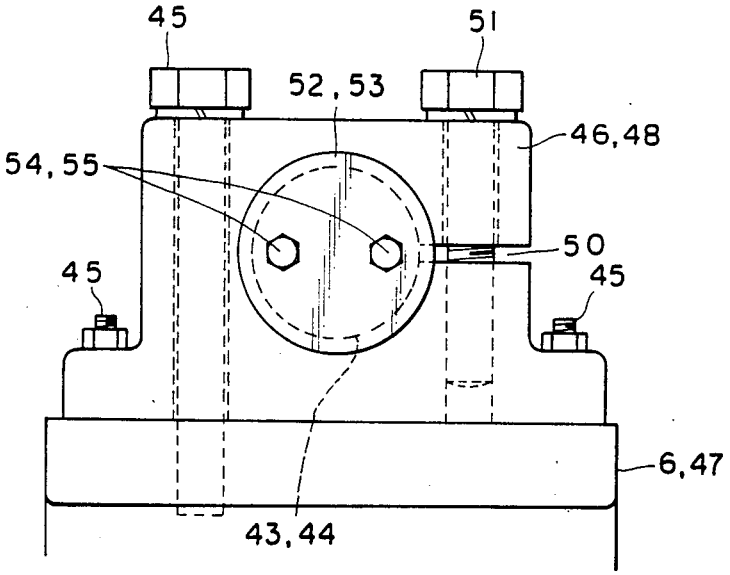
FIG. 7 is a side view showing an adjusting and fixing device.
Figure 8:
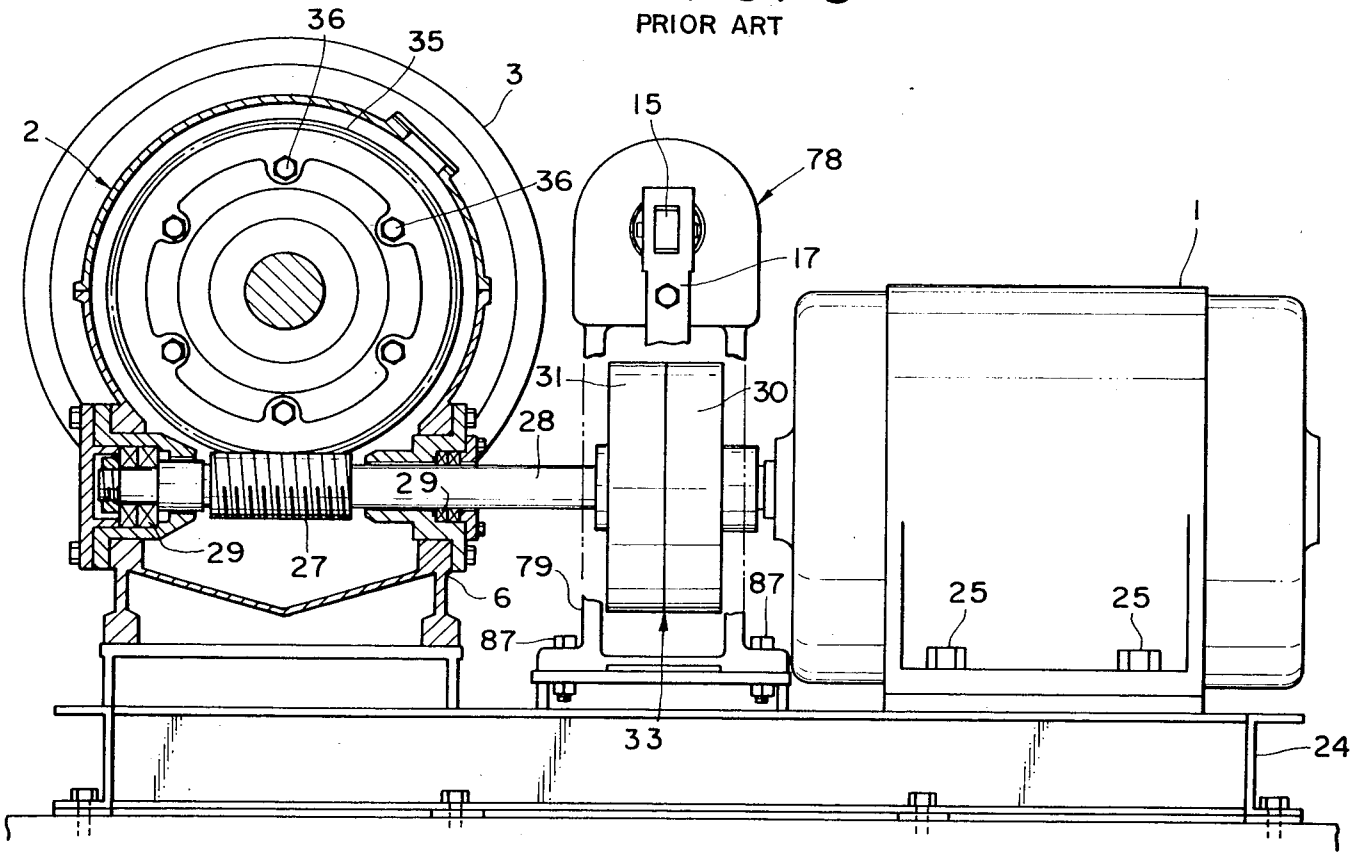
FIG. 8 PRIOR ART
Figure 9:
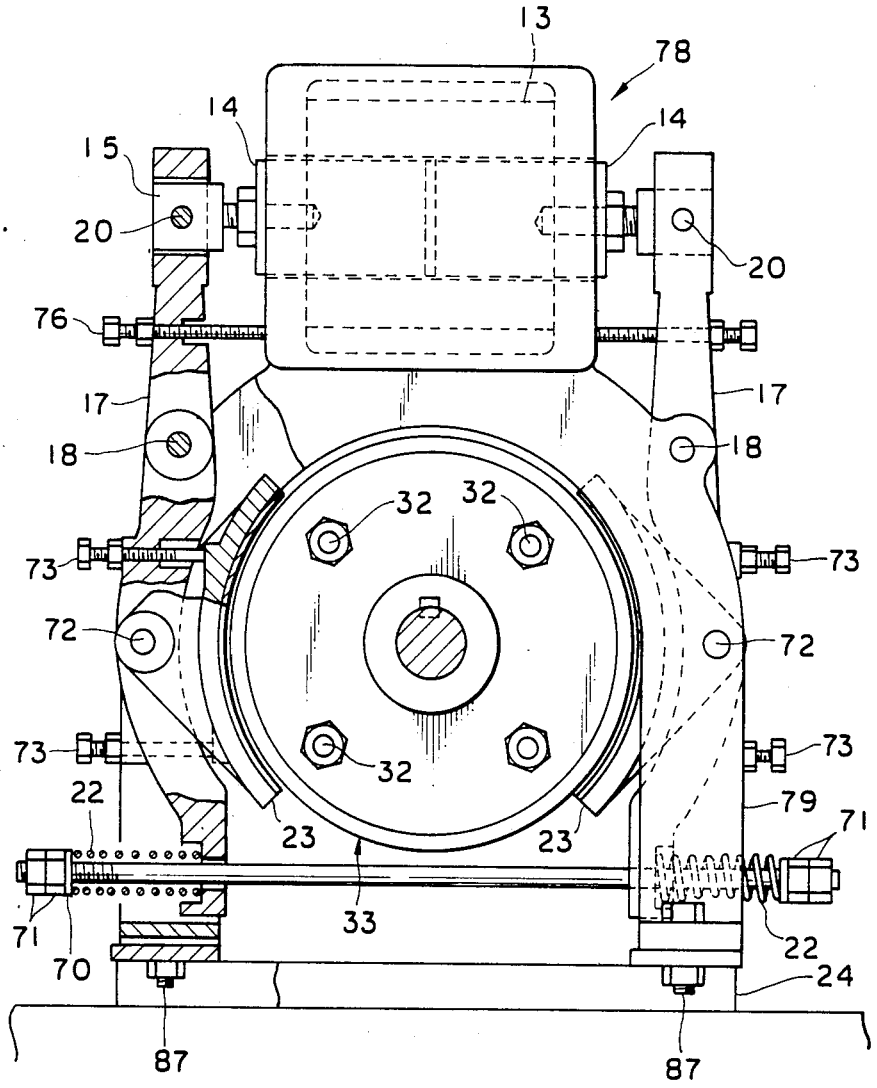
FIG. 9 PRIOR ART
Figure 10:
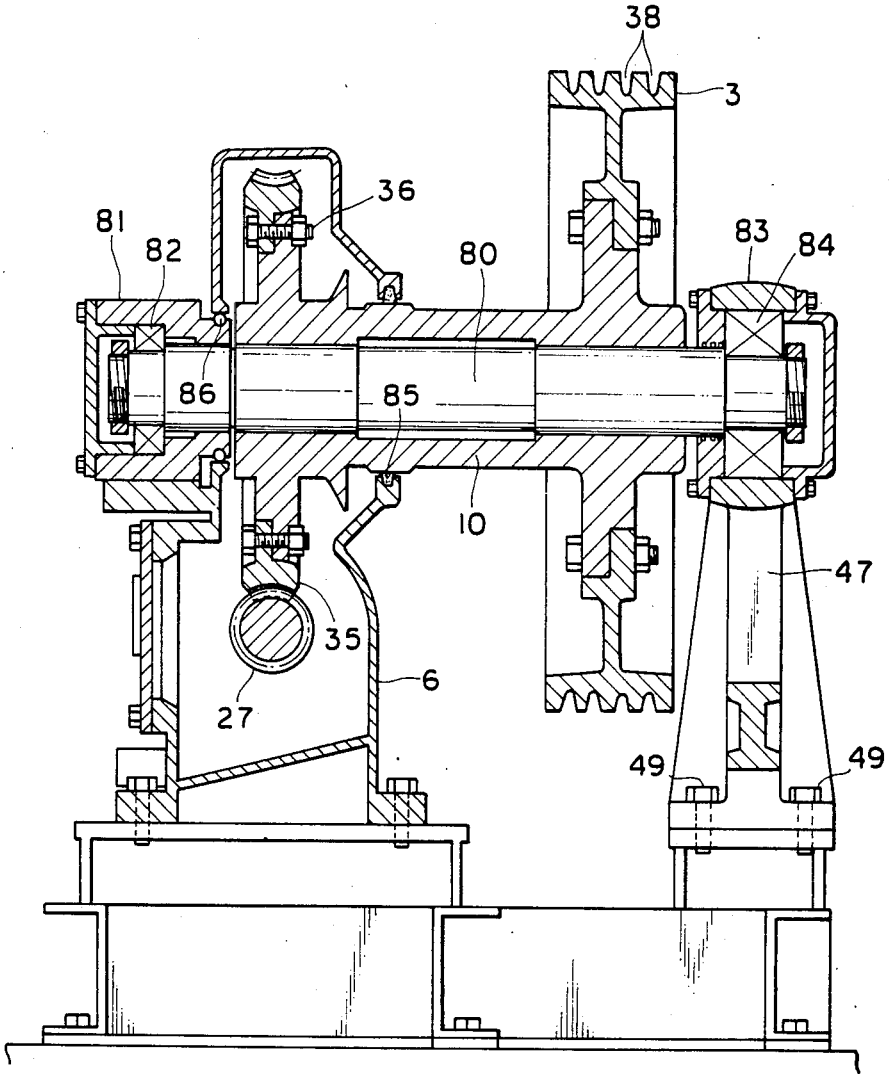
FIG. 10 PRIOR ART

FIGS. 1 to 7 show an embodiment of the present invention. A housing of a motor 1 is secured to a base frame 24 by bolts 25 while a casing 6 of a reduction gear 2 is secured by bolts 26. A drive shaft 28 provided with a worm 27 is journalled by the casing 6 through a bearing 29, and a coupling unit 30 provided with the cylindrical outside surface is fitted onto an end of a rotor shaft of the motor 1 not to rotate. The other coupling unit 31 provided with the cylindrical outside surface is fitted onto an end of the drive shaft 28 not to rotate. The respective coupling units 30, 31 are coupled with each other by bolts 32 to constitute a braked member 33 consisting of the coupling.

To a flange 34 provided on one end of a hollow rotary shaft 10 is secured an annular worm wheel 35 meshing with said worm 27 by bolts 36. To a flange 37 provided on the other end of the hollow rotary shaft 10 is secured a drive pulley 3 provided with a V shaped groove 38 by bolts 39. Further, the hollow rotary shaft 10 is supported rotatably by a horizontal fixed support shaft 40 through bearings 41, 42 not to move axially.

The center line $C_1$ of end shafts 43, 44 at both ends of the fixed support shaft 40 is spaced eccentrically by a distance D in the same direction from the center line $C_2$ of bearing fitting portions on the fixed support shaft 40. One end shaft 43 is fitted pivotably and longitudinally movably in a shaft fixing member 46 fixed to the casing 6 by bolts 45. The other end shaft 44 is fitted pivotably and longitudinally movably in a shaft fixing member 48 fixed to a support base 47 by bolts 45. Therefore, said support base 47 is secured to the base frame 24 by bolts 49.

Each of said shaft fixing members 46, 48 is provided in one side with a horizontal slit 50. A shaft fixing bolt 51 inserted into the upper side portion of the slit 50 is screwed into the lower side portion of the slit 50. The end shafts 43, 44 are fixedly clamped by the shaft fixing members 46, 48 upon tightening the shaft fixing bolt 51.

The outer ends of the respective shaft fixing members 46, 48 engage bolt engaging members 52, 53 consisting of a circular portion fitted in the interior of the shaft fixing member and a flange engaged with the outer end of the shaft fixing member. A plurality of adjusting bolts 54, 55 are inserted into the respective bolt engaging members 52, 53 to be screwed into the end shafts 43, 44.

When the engagement of the worm 27 with the worm wheel 35 is eccentric longitudinally of the fixed support shaft 40, the fixed support shaft 40 and the worm wheel 35 supported by the fixed support shaft through the hollow rotary shaft 10 are moved longitudinally of the support shaft by pivoting properly the adjusting bolts 54, 55 with the shaft fixing bolt 51 being loosened. The relative position of the worm 27 and the worm wheel 35 in the longitudinal direction of the fixed support shaft is adjusted not to be eccentric and then the shaft fixing bolt 51 is again tightened to fix the fixed support shaft 40.

When the depth of action of the worm 27 and the worm wheel 35 is not proper, the fixed support shaft 40 is pivoted by a proper angle with the shaft fixing bolt 51 being loosened to adjust said depth of action and then the shaft fixing bolt 51 is again tightened to fix the fixed support shaft 40.

Between the fixed support penetrating portion of said casing 6 and the fixed support shaft 40 is inserted a rubber sealing ring 56. In the hollow rotary shaft penetrating portion of the casing 6 is provided the annular oil keep groove 11 surrounding the hollow rotary shaft 10. Further, an annular oil interrupting projection 12 located in the oil keep groove 11 is provided integrally on the outer periphery of the intermediate portion of the hollow rotary shaft 10. An oil drain hole 57 for affording communication between the lower portion of the oil keep groove 11 and the interior of the casing 6 is provided in the casing 6. The outflow of lubricant from between the fixed support shaft penetrating portion of the casing 6 and the fixed support shaft 40 is blocked by the rubber sealing ring 56. The outflow of lubricant from between the hollow rotary shaft penetrating portion of the casing 6 and the hollow rotary shaft 10 is interrupted by the oil interrupting projection 12. The lubricant interrupted by the oil interrupting projection 12 drops into the oil keep groove 11 and then passes through the oil drain hole 57 to drop in the casing 6.

Caps 58, 59 are secured to both ends of said hollow rotary shaft 10 by bolts 60. Rubber sealing rings 61, 62 are fitted in the support shaft penetrating portions of these caps 58, 59. An oil supply hole 63 is provided in the intermediate portion of the hollow rotary shaft 10.

A brake unit mounting portion 64 of the casing 6 of the reduction gear 2 is provided with a positioning pin hole 9 and screw holes 65 located at both sides thereof. The frame 5 of the brake unit 4 is provided with a bracket 66. One end of the positioning pin 8 is fixedly forced into a pin hole provided in the bracket 66. The other end of the positioning pin 8 is fitted in said positioning pin hole 9 and inserted into the bracket 66. Therefore, the bracket 66 is secured to the brake unit mounting portion 64 by a plurality of bolts 7 screwed into said screw holes 65.

One end of said positioning pin 8 may be fixedly forced into a pin hole provided in the brake unit mounting portion 64 and the other end of the positioning pin 8 may be fitted in the positioning pin hole 9 provided in the bracket 66.

An solenoid 13 is fixedly fitted in said frame 5 and an iron cores 14 are inserted into both sides of the solenoid 13. Screw rods 16 provided integrally in support members 15 are screwed in these iron cores 14 and lock nuts 67. Further, on both sides of the frame 5 are mounted the intermediate portion of brake arm 17 to pivot about a pivot 18, and said support member 15 is inserted into a hole provided in one end of each brake are 17.

A pin 20 extends through pin inserting holes 19 in one end of the brake arm 17 and the support member 15. A clearance is provided between the periphery of the pin 20 and said pin inserting hole 19. The pin 20 abuts against the end of the fine adjustment bolt 21 screwed in the support member 15 at the opposite side to the screw rod 16. Further, a lock nut 68 is screwed onto the fine adjustment bolt 21. A screw rod 69 extends through the other end of each brake arm 17. Spring carrier washers 70 are fitted onto both ends of the screw rod 69 while nuts 71 are screwed onto said both ends. Brake springs 22 are interposed between the spring carrier washer 70 and the other end of the brake arm 17.

The intermediate portion of the brake shoe 23 opposed to the peripheral surface of said braked member 33 is mounted pivotably on the brake arm 17 by a pin 72 between the pivot 18 and the brake spring 22. Between the pivot 18 and the pin 72 is screwed a brake shoe position adjusting bolt 73 into the brake arm 17, and a lock nut 74 is screwed onto the bolt 73. Further, between the brake spring 22 and the pin 72 and between the brake arm 17 and the brake shoe 23 is interposed a spring 75 for holding the position of the brake shoe. Therefore, the position of the brake shoe 23 relative to the braked member 33 is adjusted by said brake shoe position adjusting bolt 73. Also, a stopper bolt 76 is screwed in the brake arm 17 between said pivot 18 and the pin 20, and a lock nut 77 is screwed onto the stopper bolt 76.

When current is not supplied to said solenoid 13, the brake shoe 23 is pressed against the braked member 33 by a force of the brake spring 22 so that the braked member 33 is braked not to rotate. Also, when current is supplied to the solenoid 13, each iron core 14 is attracted and moved so that each brake arm 17 is pivoted in the direction of arrow A against the force of the brake spring 22 by the movement of these iron cores 14 and each brake shoe 23 is repulsed from the braked member 33, i.e., the brake is released.

When the clearance between the left and right brake shoes 23 and the braked member 33 differ relatively largely from each other, the pin 20 is removed and then the screw rod 16 having the support member 15 and screwed into the iron core 14 is adjusted with respect to the depth therein the adjust said clearance. Also, when the clearances between the left and right brake shoes 23 and said braked member 33 differ relatively slightly from each other, the fine adjustment bolt 21 is turned to adjust the position of the pin 20 within the pin inserting hole 19. As a result said clearance is adjusted.

What is claimed is:

1. A winch for an elevator comprising:

a drive pulley (3) rotated by a motor (1) through a reduction gear (2);

a brake unit (4) provided between said motor (1) and said reduction gear (2);

wherein a brake frame (5) of the brake unit (4) provided independently of the reduction gear (2) is secured to a casing of the reduction gear (2) by a bolt (7);

a solenoid (13) is secured to said brake frame (5) of said brake unit (4);

screw rods (16) provided in support members (15) are screwed into iron cores inserted into both sides of said solenoid (13);

the intermediate portion of a brake arm (17) is connected pivotably to both sides of said brake frame (5);

a pin (20) extends through pin inserting holes (19) of one end of said brake arm (17) and said support member (15);

a clearance is provided between said pin inserting hole (19) and the periphery of said pin 20;

a fine adjustment bolt (21) screwed into said support member (15) at the opposite side to said screw rod (16) engages said pin (20);

each brake spring (22) engages the other end of each brake arm (17); and a brake shoe (23) is mounted on each brake arm (17) between a pivot (18) and said brake spring (22).

2. A winch for an elevator as defined in claim 1, wherein a positioning pin (8) secured to said brake frame (5) of said brake unit (4) is fitted in a positioning pin hole (9) provided in said casing (6) of said reduction gear (2).

3. A winch for an elevator as defined in claim 1, wherein the positioning pin (8) secured to said casing (6) of said reduction gear (2) is fitted in the positioning pin hole (9) provided in said brake frame (5) of said brake unit (4).

4. A winch for an elevator as defined in claim 1, wherein said casing (6) of said reduction gear (2) is provided with an annular oil keep groove (11) surrounding a hollow rotary shaft (10) to which is secured said drive pulley (3) and an annular oil interrupting projection (12) provided on said hollow rotary shaft (10) is disposed in said oil keep groove (11).

* * * * *